US007959445B1

(12) United States Patent
Daily et al.

(10) Patent No.: US 7,959,445 B1
(45) Date of Patent: Jun. 14, 2011

(54) BOARD-TO-BOARD CONNECTOR SYSTEM

(75) Inventors: Christopher George Daily, Harrisburg, PA (US); Rohan Narang, Harrisburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/549,653

(22) Filed: Aug. 28, 2009

(51) Int. Cl.
*H01R 12/00* (2006.01)

(52) U.S. Cl. ..... 439/65; 439/928

(58) Field of Classification Search ..... 439/65, 439/928, 287, 507, 310
See application file for complete search history.

(56) References Cited

U.S. PATENT DOCUMENTS

| | | | | |
|---|---|---|---|---|
| 4,816,789 | A * | 3/1989 | Mars | 333/246 |
| 4,865,553 | A | 9/1989 | Tanigawa et al. | |
| 5,325,267 | A * | 6/1994 | Ewing | 361/760 |
| 5,743,755 | A * | 4/1998 | Aoki | 439/354 |
| 6,986,667 | B2 * | 1/2006 | Chang et al. | 439/65 |
| 7,387,521 | B1 | 6/2008 | Weber | |
| 7,448,873 | B2 | 11/2008 | Weber | |
| 7,455,528 | B2 * | 11/2008 | Cox et al. | 439/65 |
| 7,611,358 | B2 * | 11/2009 | Cox et al. | 439/65 |
| 2004/0094328 | A1 | 5/2004 | Fjelstad et al. | |
| 2008/0171451 | A1 | 7/2008 | Shin et al. | |
| 2008/0293262 | A1 * | 11/2008 | Duesterhoeft et al. | 439/65 |
| 2010/0136804 | A1 * | 6/2010 | Strickland | 439/65 |

FOREIGN PATENT DOCUMENTS

EP 1 775 796 4/2007

OTHER PUBLICATIONS

AVX Interconnect, LED Lighting Application, www.avx.com, 2 pgs.
International Search Report, International Application No. PCT/US2010/002335, International Filing Date, Aug. 25, 2010.

* cited by examiner

*Primary Examiner* — Michael C Zarroli

(57) ABSTRACT

A connector system includes a first contact module terminated to a first circuit board proximate to an edge of the first circuit board. The first contact module has a first housing holding first contacts that are electrically connected to the first circuit board. The connector system also includes a second contact module terminated to a second circuit board proximate to an edge of the second circuit board. The second contact module having a second housing holding second contacts that are electrically connected to the second circuit board. A jumper module electrically connects the first contacts and the second contacts, where the jumper module is movable independently of the first and second housings between a mated state and an unmated state. The first and second contacts are electrically connected in the mated state. When the jumper module is in the unmated state, the first circuit board and the second circuit board can be brought together from a plurality of different directions. The jumper module is moved to the mated state after the first and second circuit boards are brought together.

20 Claims, 12 Drawing Sheets

BOARD-TO-BOARD CONNECTOR SYSTEM

BACKGROUND OF THE INVENTION

The subject matter herein relates generally to electrical connector systems, and more particularly, to connector systems for electrically connecting adjacent circuit boards together.

Connector assemblies are required to provide electrical power or electrical or electronic control signals between components, such as power sources, computers, auxiliary hardware, or other electrical components within an electrical or electronic system. Often, these components contain panel members, such as circuit boards, which are populated with miniaturized components to provide the desired electrical control. One example of an electrical system that utilizes such circuit boards and connector assemblies is a lighting system that utilizes multiple light boards having light emitting diodes (LEDs) connected to the circuit boards. The light boards are arranged end-to-end and power is transferred from one light board to the next by connector assemblies at the ends of the light boards. Typically, the connector assemblies includes electrical contacts that extend from a housing that is secured adjacent to one end of the light board.

Known lighting systems utilizing light boards are not without disadvantages. For instance, the light boards include connector assemblies that are configured to permit coupling by directing the circuit boards and connector assemblies toward each other in only one direction. For example, one circuit board is held stationary, while the other circuit board is moved toward the stationary board in a direction that is parallel to the plane of the circuit board. As such, the connector assembly of one of the circuit boards, which constitutes a plug, is loaded into the other connector assembly, which constitutes a receptacle. The circuit boards must also be disassembled in the same manner of being moved directly away from the other circuit board in a direction that is parallel to the circuit board. When many boards are used and arranged in an-end-to-end stacked configuration, it is difficult and impractical to remove an interior circuit board without also removing every other circuit board outside of the circuit board that is desired to be removed without damaging adjacent circuit boards or components on the circuit board, such as the connector assemblies.

What is needed is a connector system that utilizes connector assemblies that are secured to circuit boards and that are capable of being brought into electrical contact with each other from a plurality of different directions.

BRIEF DESCRIPTION OF THE INVENTION

In one embodiment, a connector system is provided that includes a first contact module terminated to a first circuit board proximate to an edge of the first circuit board. The first contact module has a first housing holding first contacts that are electrically connected to the first circuit board. The connector system also includes a second contact module terminated to a second circuit board proximate to an edge of the second circuit board. The second contact module having a second housing holding second contacts that are electrically connected to the second circuit board. A jumper module electrically connects the first contacts and the second contacts, where the jumper module is movable independently of the first and second housings between a mated state and an unmated state. The first and second contacts are electrically connected in the mated state. When the jumper module is in the unmated state, the first circuit board and the second circuit board can be brought together from a plurality of different directions. The jumper module is moved to the mated state after the first and second circuit boards are brought together.

In another embodiment, a connector system is provided that includes a first contact module terminated to a first circuit board proximate to an edge of the first circuit board that has a first housing holding first contacts. The first contacts are electrically connected to the first circuit board. The first contact module has a receiving part. A second contact module is terminated to a second circuit board proximate to an edge of the second circuit board. The second circuit board has a top surface defining a board plane. The second contact module has a second housing mounted to the top surface of the second circuit board at pads electrically connected to the second circuit board. The second housing has a receiving space that receives the receiving part of the first contact module, wherein the receiving space is configured to receive the receiving part in a direction that is non-parallel to the board plane of the second circuit board. The first contacts are electrically connected to the pads when the receiving part is received in the receiving space.

In a further embodiment, a connector system is provided for interconnecting first and second circuit boards together, where the first and second circuit boards each having a top surface defining a board plane and a board perimeter, and where the first and second circuit boards each having a mating edge. The connector system includes a first contact module having a first housing holding first contacts that are configured to be terminated to the first circuit board proximate to the mating edge of the first circuit board. The first contact module is arranged on the top surface of the first circuit board such that the first contact module is entirely within the board perimeter of the first circuit board. The connector system also includes a second contact module having a second housing holding second contacts that are configured to be terminated to the second circuit board proximate to the mating edge of the second circuit board. The second contact module is arranged on the top surface of the second circuit board such that the second contact module is entirely within the board perimeter of the second circuit board. A jumper module is configured to be coupled to the first and second contact modules, where the jumper module is movable independently of the first and second housings between a mated state and an unmated state. When in the mated state, the jumper module spans across the mating edges to electrically connect the first and second contacts, and when in the unmated state, the jumper module is positioned in a non-blocking position with respect to the mating edges such that the first circuit board and the second circuit board can be brought together, or taken apart, in a direction that is non-parallel to the board planes.

DETAILED DESCRIPTION OF THE INVENTION

Figure 1:
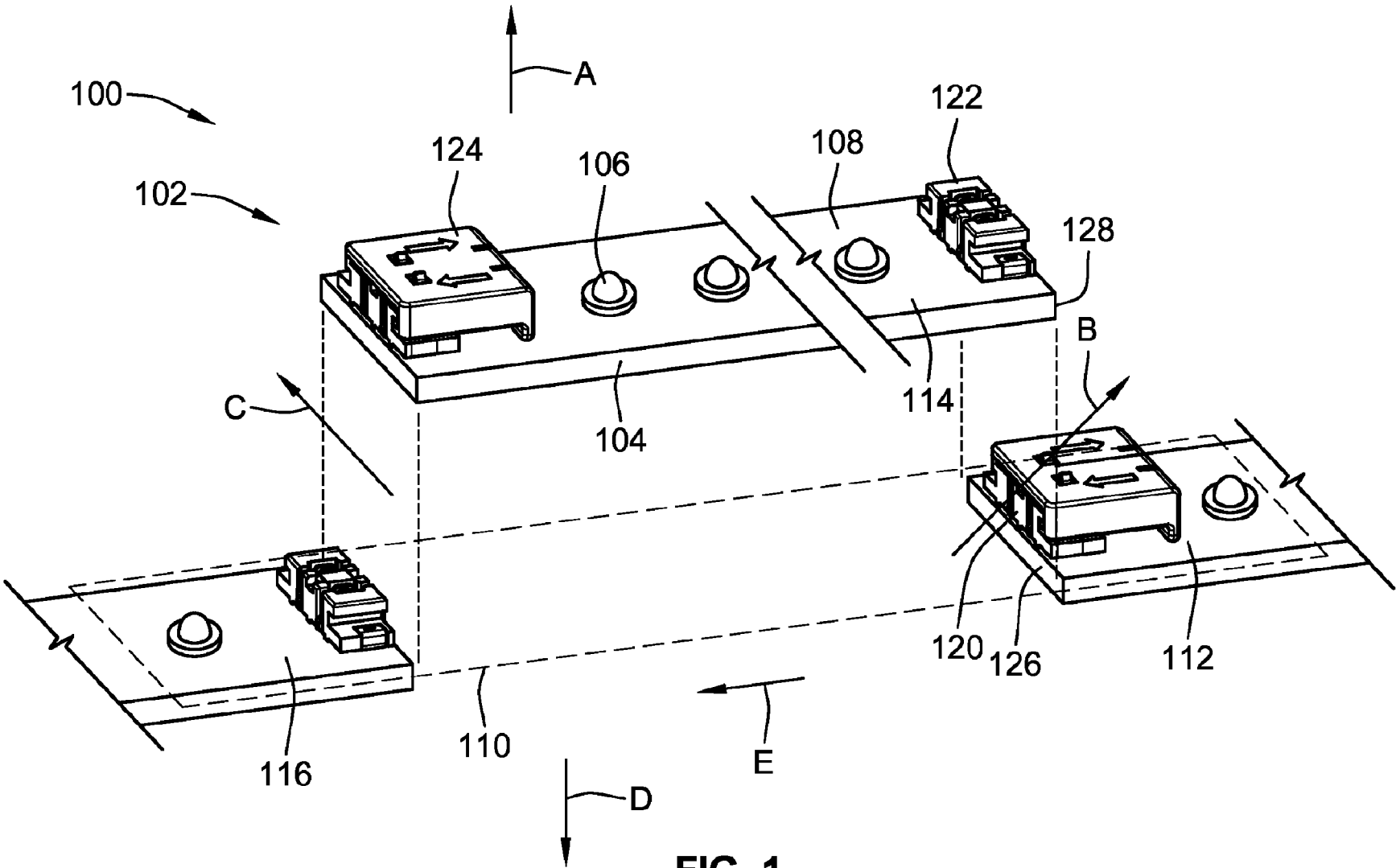
FIG. 1 illustrates a connector system formed in accordance with an exemplary embodiment.

FIG. 1 illustrates a connector system 100 formed in accordance with an exemplary embodiment. The connector system 100 utilizes connector assemblies 102 to interconnect electrical components 104 to one another. In the illustrated embodiment, electrical components 104 constitute circuit boards 104 arranged end-to-end in a stacked configuration. Any number of circuit boards 104 may be connected together. In an exemplary embodiment, the connector system 100 is an electrical system that distributes electrical power from one electrical component 104 to the next electrical component 104. Alternatively, the connector system 100 may additionally or alternatively transmit electrical control signals (e.g. data).

The circuit boards 104 each may be light boards that include a plurality of light emitting diodes (LEDs) 106 mounted to a top surface 108 of the circuit boards 104. The LEDs 106 may be arranged in any pattern to provide a desired illumination effect. The circuit boards 104 generally define a board plane 110 along and/or parallel to the top surface 108. When the connector system 100 is finally assembled, each of the circuit boards 104 are arranged coplanar with one another along the board plane 110.

FIG. 1 illustrates a first circuit board 112, a second circuit board 114, and a third circuit board 116. The second circuit board 114 is configured to be positioned between the first and third circuit boards 112, 116. During assembly, the circuit boards 112, 114, 116 may be coupled to one another in many different ways. The circuit boards 112, 114, 116 may ultimately be mounted to a common substrate, heat sink or other supporting structure. Once properly positioned, any or all of the circuit boards 112, 114, 116 may be fixedly secured to the supporting structure, such as by using fasteners or an adhesive. As will be described in further detail below, any of the circuit boards may be removed and/or replaced without having to remove adjacent circuit boards. For example, the second circuit board 114, which is between the first and third circuit boards 112, 116, may be removed without having to remove the first or third circuit boards 112, 116. For example, the second circuit board 114 may be removed in a direction that is generally away from the supporting structure, such as in the direction of arrow A. In an application in which the supporting structure and circuit boards 112, 114, 116 are arranged horizontally, the second circuit board 114 may be removed in a vertical direction. Alternatively, the second circuit board 114 may be tilted at angle or rotated outward with respect to the supporting structure to clear either the first or third circuit boards 112, 116 for removal therefrom, such as in the direction of arrow B or arrow C. In the situation where no supporting structure is provided, or it is not provided directly below the circuit boards 112, 114, 116, the second circuit board 114 may be removed in a downward direction from below the first and third circuit boards 112, 116, such as in the direction of the arrow D. Because the first circuit board 112 is on one side of the second circuit board 114 and because the third circuit board 116 is on the opposite side of the second circuit board 114, it may be difficult to move the second circuit board 114 in a horizontal direction towards either the first circuit board 112 or the third circuit board 116. Similarly, the second circuit board 114, which may be a replacement circuit board, may be loaded into position and brought together with respect to the first circuit board 112 and/or the third circuit board 116 in similar ways, such as downward, upward, at an angle or rotated. In the situation in which the third circuit board 116 is not yet positioned, the second circuit board 114 may be loaded into position and brought together with respect to the first circuit board 112 in a direction generally parallel to the board plane 110, such as in a horizontal direction or in the direction of arrow E.

When the circuit boards 112, 114, 116 are brought together, the connector assemblies 102 are used to electrically connect the circuit boards 112, 114, 116 to one another. One particular type of connector assembly 102 is illustrated in FIG. 1 that utilizes a first contact module 120, a second contact module 122 and a jumper module 124 that electrically connects the first and second contact modules 120, 122 to one another. The first contact module 120 is terminated to the first circuit board 112 proximate to an edge 126 thereof. The second contact module 122 is terminated to the second circuit board 114 proximate to an edge 128 thereof. Other types of connector assemblies may be utilized in alternative embodiments to couple the circuit boards together. The connector assemblies 102 are merely illustrative, and the subject matter herein is not intended to be limited to the connector assemblies 102 illustrated in FIG. 1.

Figure 2:
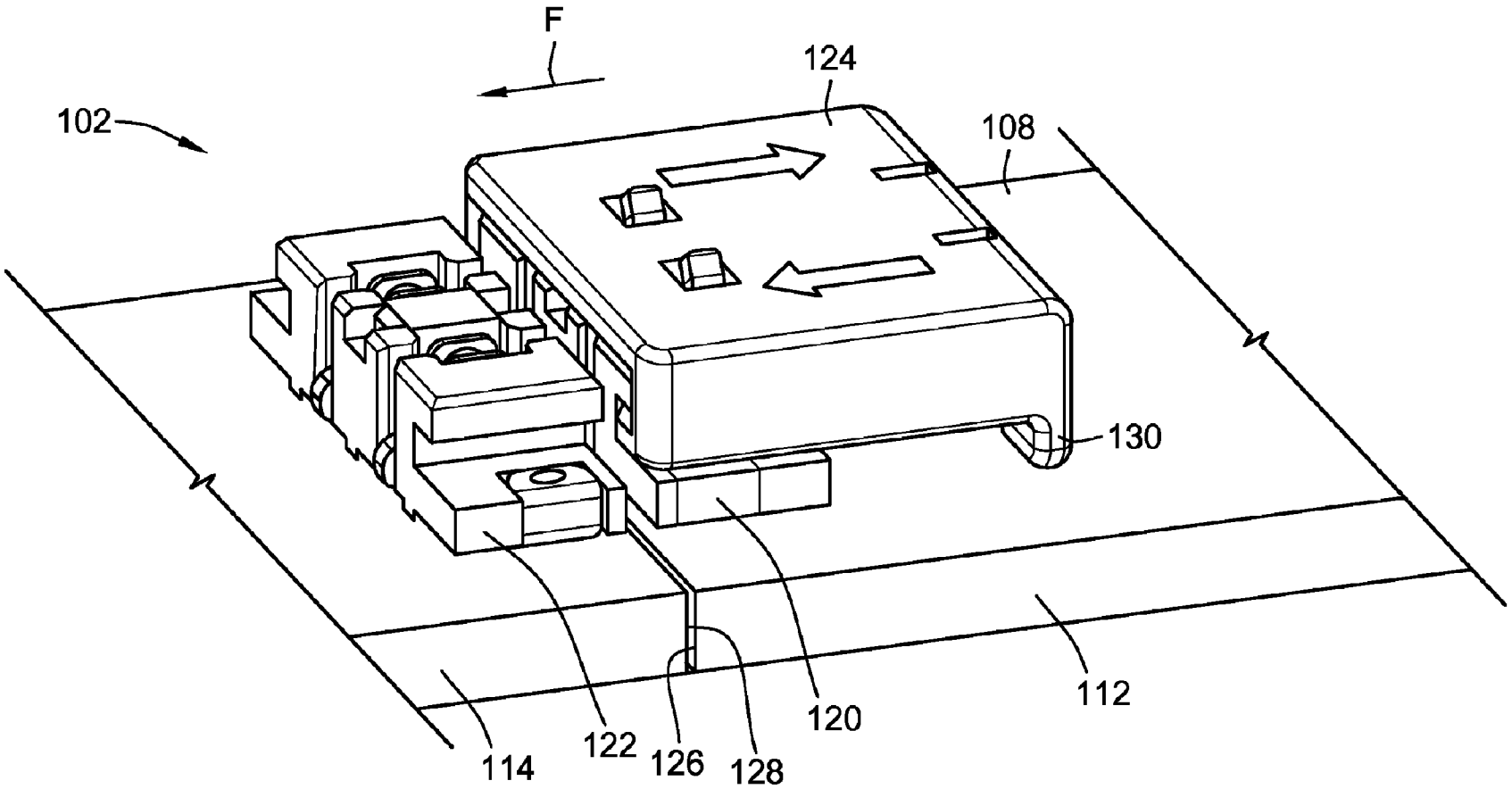
FIG. 2 illustrates an exemplary connector assembly for the connector system shown in FIG. 1 in an unmated state.

FIG. 2 illustrates an exemplary connector assembly 102 for the connector system 100 (shown in FIG. 1) in an unmated state. When the first and second circuit boards 112, 114 are brought against each other and properly positioned, the edges 126, 128 face one another. Optionally, the edges 126, 128 may abut against one another. Alternatively, the edges 126, 128 may be in close proximity to one another but may be spaced apart from one another by a gap. The gap may accommodate manufacturing tolerances of the circuit boards 112, 114. When the first and second circuit boards 112, 114 are brought against each other, the top surfaces 108 of the circuit boards 112, 114 are generally aligned coplanar with one another.

Once the circuit boards 112, 114 are positioned, the contact modules 120, 122 are aligned with one another. In an exemplary embodiment, the first contact module 120 is recessed from the edge 126 and the second contact module 122 is recessed from the edge 128. Neither contact module 120, 122 hangs over the corresponding edge 126, 128. Rather, the contact modules 120, 122 remain within the perimeter defined by the top surfaces 108 of the circuit boards 112, 114. As such, neither of the contact modules 120, 122 would interfere with the other circuit board 114, 112, respectively during the insertion or removal of the circuit board 114, 112. For example, the first circuit board 112 may be moved vertically upward or downward with respect to the second circuit board 114, and the second contact module 122 does not interfere with such movements of the first circuit board 112.

The jumper module 124 is utilized to electrically contact the first and second contact modules 120, 122. In an exemplary embodiment, the jumper module 124 is movable independently of the first and second contact modules 120, 122. For example, the jumper module 124 may be moved linearly in a sliding direction, shown by the arrow F, between a mated position and an unmated position. The jumper module 124 is illustrated in the unmated position in FIG. 2. In the unmated position, the jumper module 124 is coupled to the first contact module 120 and in the mated position, the jumper module 124 is coupled to both the first and second contact modules 120, 122. The jumper module 124 represents a receiving part of the connector assembly 102. The jumper module 124 may be considered as part of the first contact module 120 as the jumper module 124 is physically coupled to the first contact module 120 as the circuit board 114 is moved around and positioned against the first circuit board 112.

During mating, the jumper module 124 may be slid towards the second contact module 122 to a mated position, in which the jumper module 124 is coupled to both the first contact module 120 and the second contact module 122. The second contact module 122 may include a receiving space that receives the receiving part of the connector assembly 102, which is represented by the jumper module 124. The jumper module 124 includes a guide 130 and engages the top surface 108 of the first circuit board 112. The guide 130 slides along the top surface 108 as the jumper module 124 is slid between the mated position and the unmated position. In the mated position, the jumper module 124 spans across the gap between the edges 126, 128 of the circuit boards 112, 114. The jumper module 124 is positioned above both the first circuit board 112 and the second circuit board 114 when in the mated position.

Figure 3:
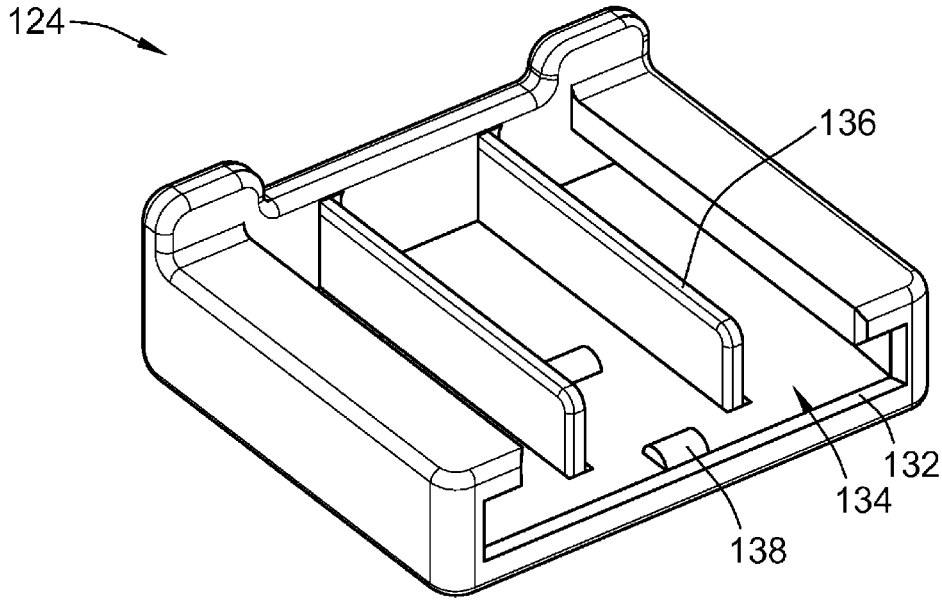
FIG. 3 is a bottom perspective view of a jumper module for the contact modules shown in FIG. 2.

FIG. 3 is a bottom perspective view of the jumper module 124. The jumper module 124 includes a body 132 having an opening 134 therein. In an exemplary embodiment, the opening 134 is generally T-shaped, however the opening may have any shape that receives the first and/or second contact modules 120, 122. The jumper module 124 includes jumper contacts 136 held by the body 132. The jumper contacts 136 are generally planar and parallel to one another. The body 132 includes protrusions 138 that extend into the opening 134. The protrusions 138 are configured to engage either the first contact module 120 (shown in FIG. 2) when in the unmated position or the second contact module 122 (shown in FIG. 2) when in the mated position.

Figure 4:
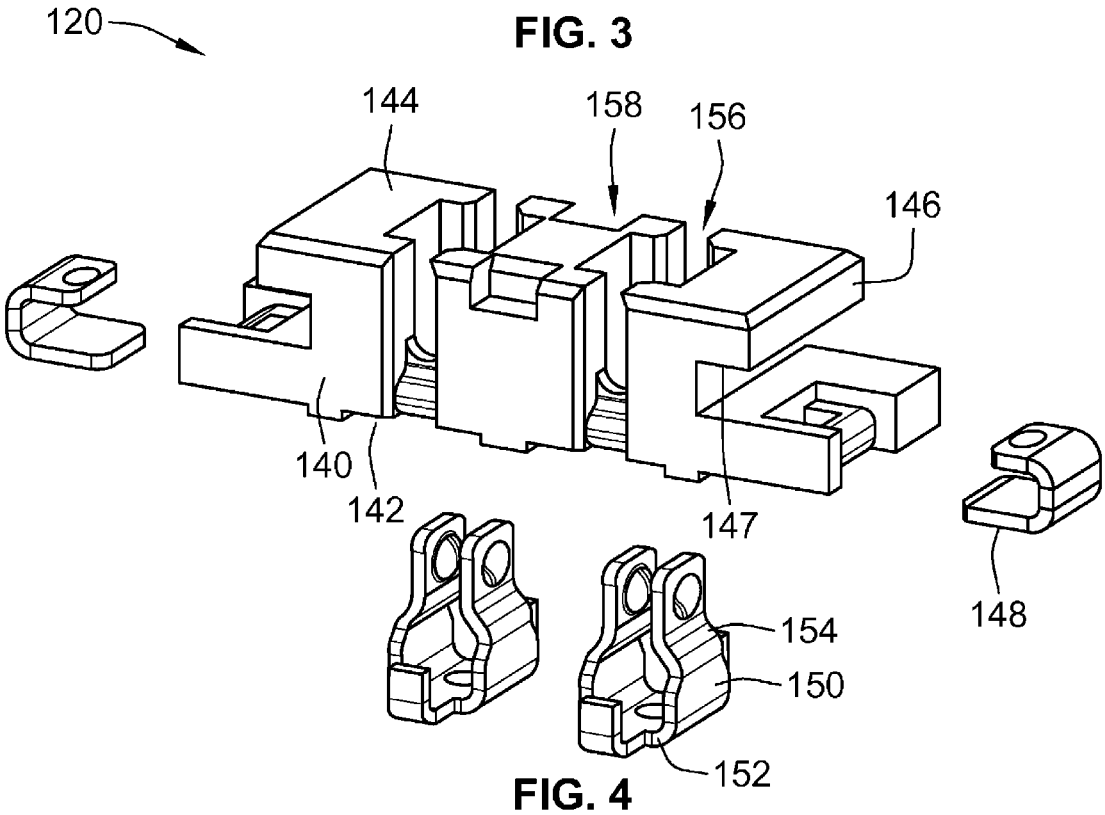
FIG. 4 is a bottom perspective view of one of the contact modules shown in FIG. 2.

FIG. 4 is an exploded perspective view the first contact module 120. In an exemplary embodiment, the second contact module 122 (shown in FIG. 2) is identical to, or substantially similar to, the first contact module 120. Optionally, the first contact module 120 may also include the jumper module 124. The contact module 120 includes a base 140 having a bottom 142 and a top 144. A cap 146 is provided at the top 144 which defines downward facing ledges 147. The cap 146 and the base 140 define a generally T-shaped top for the contact module 120. The T-shaped top is configured to fit within the T-shaped opening 134 (shown in FIG. 3) of the jumper module 124 (shown in FIG. 3). The cap 146 and the base 140 may have other shapes in alternative embodiments that correspond to the shape of the opening 134. The cap 146 and ledges 147 guide the jumper module 124 to hold the jumper module 124 onto the contact module 120.

The contact module 120 includes mounting pads 148 at the bottom 142. The mounting pads 148 are configured to be secured to the top surface 108 (shown FIG. 1). For example, the mounting pads 148 may be soldered to corresponding pads on the top surface 108. Alternative securing means may be provided in alternative embodiments, such as pins, fasteners, adhesives and the like.

The contact module 120 includes a pair of contacts 150 held by the base 140. Any number of contacts 150 may be provided depending on the particular application. The contacts 150 have a mounting portion 152 configured for mounting to the circuit board 112. In the illustrated embodiment, the mounting portion 152 represents a mounting pad configured to be surface mounted, and soldered, to the circuit board 112. Alternatively, the contacts 150 may have an alternative type of mounting portion 152, such as a pin for through hole mounting to a via of the circuit board 112. Each contact 150 includes a pair of contact arms 154 that are open at the top thereof generally opposite the mounting portion 152. Optionally, the contact 150 may be generally U-shaped with the mounting portion 152 at the base of the U-shaped body.

The base 140 includes channels 156 therethrough that provide access to the contacts 150. In the illustrated embodiment, the channels 156 are U-shaped. The channels 156 and the contacts 150 receive define the receiving space that is configured to the jumper contacts 136 therein. The jumper contact 136, which define the receiving port may be slidable through the channels 156 and contact 150 as the jumper contact 136 are moved between the mated state and the unmated state. The base 140 includes notches 158 that receive the protrusions 138 (shown in FIG. 3). The notches 158 may hold the protrusions 138 to hold the jumper module 124 in position with respect to the base 140.

Figure 5:
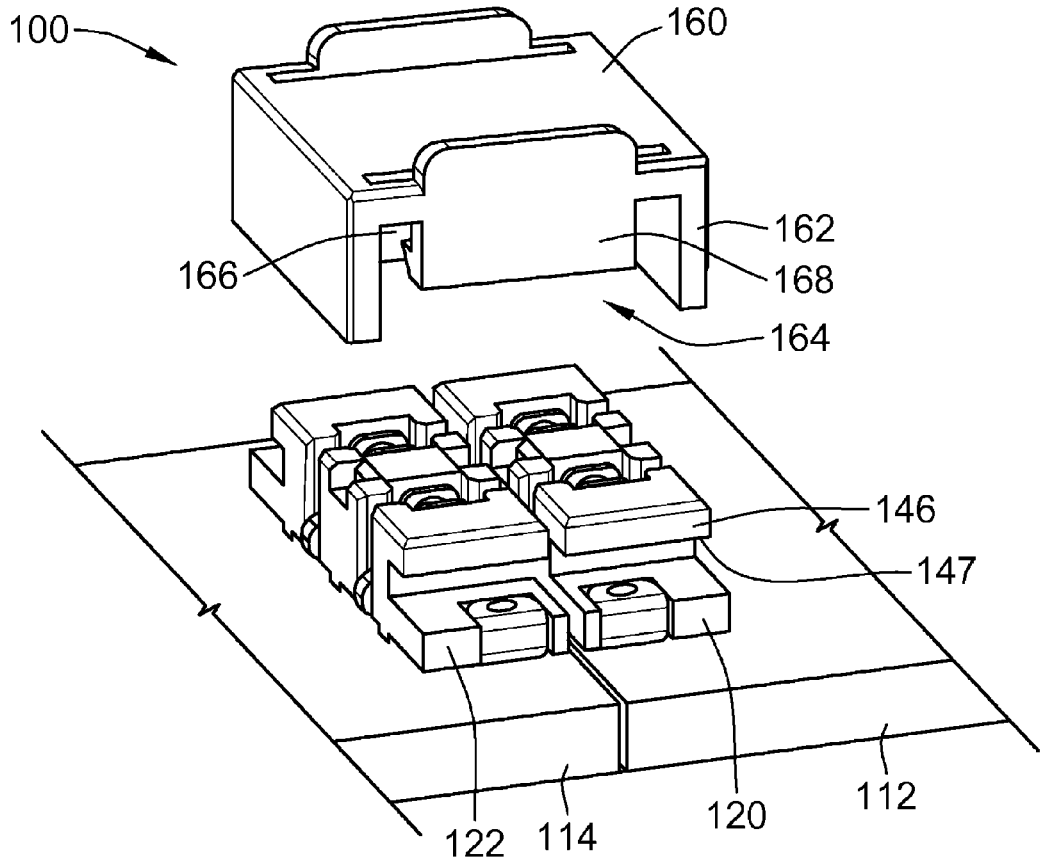
FIG. 5 illustrates an alternative jumper module for the connector system shown in FIG. 1.

FIG. 5 illustrates an alternative jumper module 160 for the connector system 100. The jumper module 160 may replace the jumper module 124 (shown in FIG. 1) and may be coupled to the same contact modules 120, 122. The jumper module 160 is illustrated in an unmated state. When the jumper module 160 is coupled to the contact modules 120, 122, the jumper module 160 is in a mated state, wherein an electrical connection is made between the contact modules 120, 122 by the jumper module 160. When the jumper module 160 is in the unmated state, the circuit boards 112, 114 may be brought together, or taken away from each other, in multiple directions, including a vertically upward direction, a vertically downward direction, a horizontal direction, an angled direction, a rotated direction, and the like. Neither the jumper module 160 nor the contact modules 120, 122 block the movement of the circuit boards 112, 114 with respect to one another.

The jumper module 160 includes a body 162 having an opening 164 along a bottom thereof. The jumper module 160 includes jumper contacts 166 held by the body 162. In an exemplary embodiment, the jumper contacts 166 are generally planar and parallel to one another.

The jumper module 160 includes deflectable latches 168 along the sides of the body 162. The latches 168 may be securely attached to the caps 146 of the contact modules 120, 122. For example, the latches 168 may be captured under the ledges 147. The latches 168 may be deflected outward to clear the ledges 147 and remove the jumper module 160 from the contact modules 120, 122.

Figure 6:
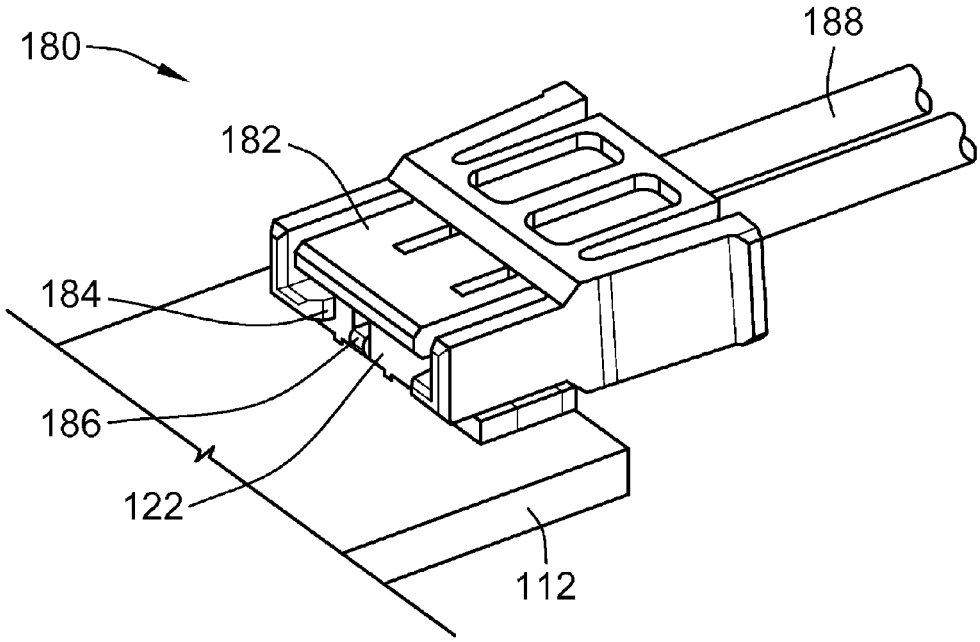
FIG. 6 illustrates a cable connector mated with one of the contact modules shown in FIG. 2.

FIG. 6 illustrates a cable connector 180 mated with the contact module 122. In order to bring electrical power to the string of circuit boards, a power connector, such as the cable connector 180 shown in FIG. 6, is electrically connected to one of the circuit boards. FIG. 6 illustrates the cable connector 180 being electrically connected to the one of contact modules 122 of the first circuit board 112. Other circuit boards may be electrically connected to the first circuit board 112 using connector assemblies similar to the connector assembly 102 (shown in FIG. 1).

The cable connector 180 includes a body 182 having deflectable latches 184 that securely attach the cable connector 180 to the contact module 120. The cable connector 180 includes a pair of contacts 186 that are terminated to ends of wires 188. The contacts 186 engage, and are electrically connected to, the contacts 150 (shown in FIG. 4) of the contact module 120.

Figure 7:
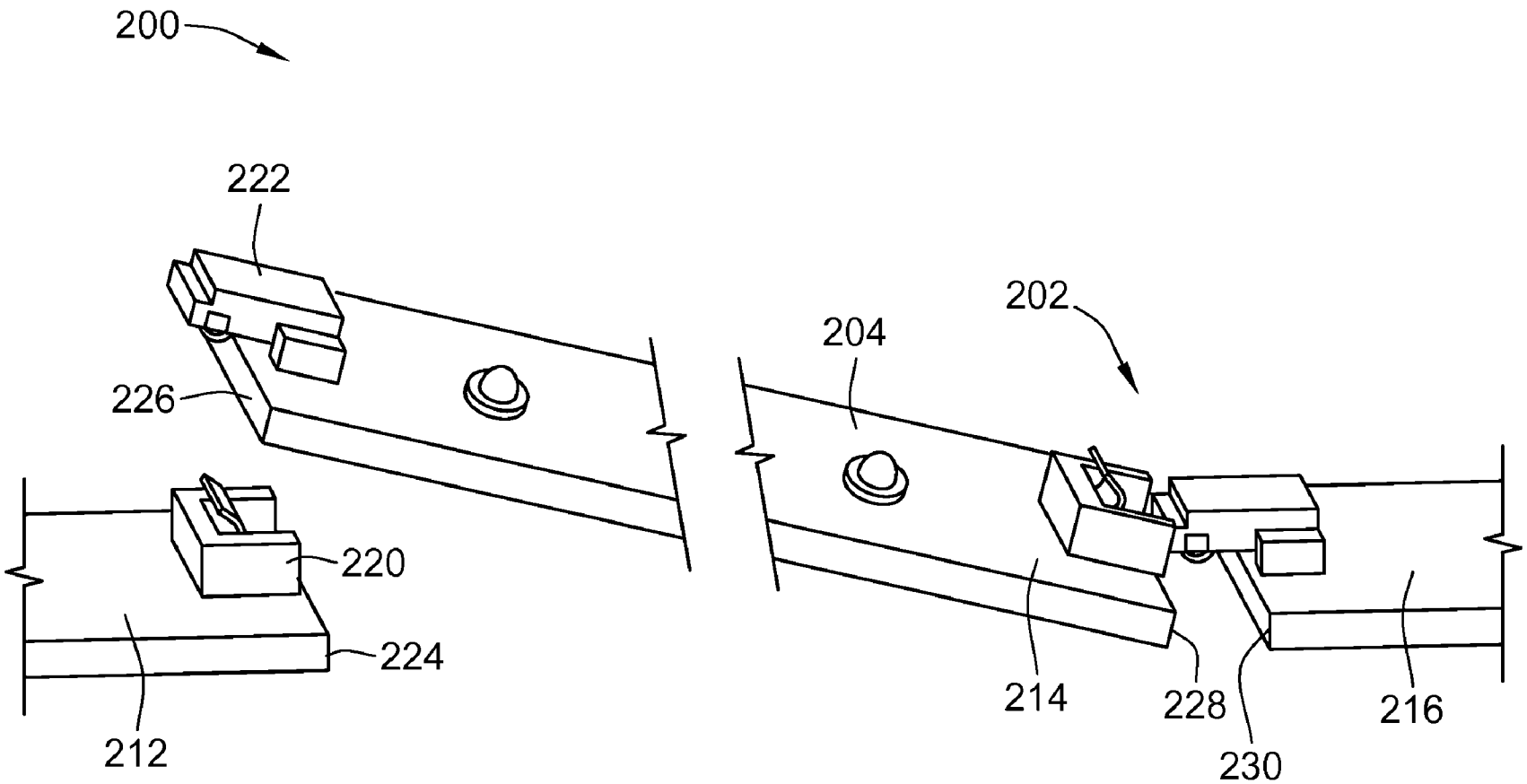
FIG. 7 illustrates an alternative connector system.

FIG. 7 illustrates an alternative connector system 200. The connector system 200 utilizes connector assemblies 202 to interconnect circuit boards 204 to one another. The connector assemblies 202 differ from the connector assemblies 102 illustrated in FIG. 1. Optionally, the circuit boards 204 may be substantially similar to the circuit boards 104 illustrated and FIG. 1.

In the illustrated embodiment, a first circuit board 212, a second circuit board 214, and a third circuit board 216 are being coupled to one another using the connector assemblies 202. The second circuit board 214 is being loaded between the first and third circuit boards 212, 216 at an angle.

Each connector assembly 202 includes a first contact module 220 and a second contact module 222 that are electrically connected to one another. The first contact module 220 is terminated to the first circuit board 212 proximate to an edge 224 thereof. The second contact module 222 is terminated to the second circuit board 214 proximate to an edge 226 thereof. In an exemplary embodiment, the first contact module 220 constitutes a receptacle and the second contact module 222 constitutes a plug that is received in the receptacle. During assembly, the first and second circuit boards 212, 214 are brought against each other, and when properly positioned, the edges 224, 226 face one another. When the first and second circuit boards 212, 214 are brought against each other, the top surfaces of the circuit boards 212, 214 are generally aligned coplanar with one another. As the circuit boards 212, 214 are brought into position, the contact modules 220, 222 are mated with one another. In an exemplary embodiment, the first contact module 220 is recessed from the edge 224 and the second contact module 222 extends outward from the edge 226.

A first contact module 220 is mounted to an edge 228 of the second circuit board 214 generally opposite to the edge 224 of the second circuit board 214, and a second contact module 222 is mounted to an edge 230 of the third circuit board 216 for mating with the first contact module 220 at the edge 228 of the second circuit board 216.

Figure 8:
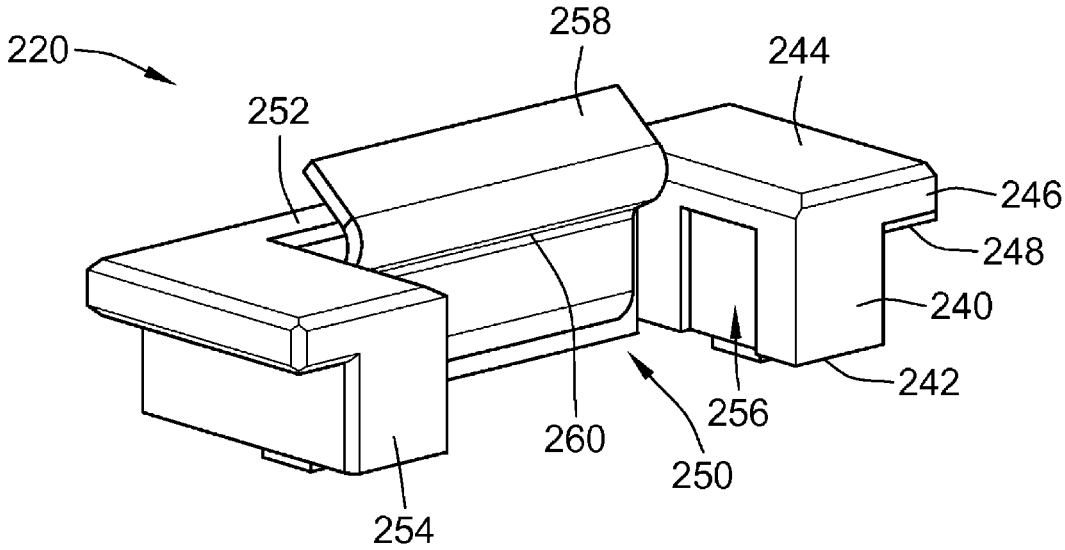
FIG. 8 is a top perspective view of a contact module for the connector system shown in FIG. 7.

FIG. 8 is a top perspective view of the first contact module 220. The contact module 220 includes a first housing 240 having a bottom 242 and a top 244. The first housing 240 has a cap 246 at the top 244. The cap 246 has a downward facing ledge 248. The bottom 242 is configured to be mounted to the top surface of the circuit board, such as by soldering to mounting pads 292 (shown in FIG. 10).

The first housing 240 includes a receiving space 250 configured to receive a portion of the second contact module 222 (shown in FIG. 7). The receiving space 250 is represented by a chamber having an open top, an open bottom, and an open front. The first housing 240 is generally U-shaped around the receiving space 250. The first housing 240 includes a back wall 252 and sidewalls 254 that extend forward from a back wall 252. In an exemplary embodiment, the sidewalls 254 have dimples 256 formed therein.

The contact module 220 includes a securing feature 258 that is configured to hold the second contact module 222 within the receiving space 250. In the illustrated embodiment, the securing feature 258 is represented by a metal clip. Other types of securing features such as latches or fasteners may be used to secure the second contact module 222 within the receiving space 250. The clip has a convoluted shape including a downward facing ledge 260. The clip may be deflected rearwardly to allow ingress and egress into and out of the receiving space 250.

Figure 9:
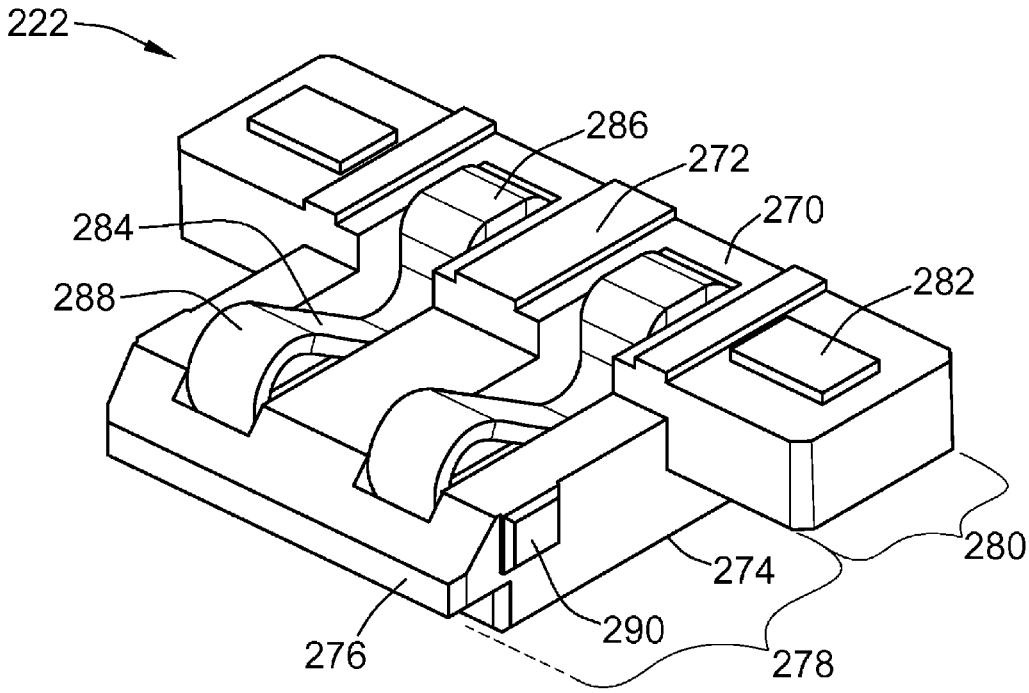
FIG. 9 is a bottom perspective view of another contact module for the connector system shown in FIG. 7.

FIG. 9 is a bottom perspective view of the second contact module 222. The contact module 222 includes a second housing 270 having a bottom 272 and a top 274. The second housing 270 includes a front edge 276. The front edge 276 is configured to engage the securing feature 258 (shown in FIG. 8). The front edge 276 is configured to be captured under the downward facing ledge 260 (shown in FIG. 8). The second housing 270 includes a mounting portion 278 and a mating portion 280 that extends forward from a mounting portion 278 to the front edge 276. The mounting portion 278 is configured to be coupled to the second circuit board 214 (shown in FIG. 7). The mating portion 280 defines a receiving part of the second contact module 222 that is configured to be received within the receiving space 250 (shown in FIG. 8).

The contact module 220 includes mounting pads 282 at the bottom 272 of the mounting portion 278. The mounting pads 282 are configured to be secured to the top surface of the second circuit board 214. For example, the mounting pads 282 may be soldered to corresponding pads on the top surface. Alternative securing means may be provided in alternative embodiments, such as pins, fasteners, adhesives and the like.

The contact module 222 includes a pair of contacts 284 held by the second housing 270. Any number of contacts 284 may be provided depending on the particular application. The contacts 284 each have a mounting portion 286 configured for mounting to the circuit board 214 and a mating portion 288 configured for mating to the first circuit board 212. In the illustrated embodiment, the mounting portion 286 represents a mounting pad configured to be surface mounted, and soldered, to the circuit board 214. The mating portion 288 represents a spring contact that may be biased against corresponding pads on the top surface of the first circuit board 212. The mating portions 288 of the contacts 284 extend along the mating portion 280 of the second housing 270. The mating portions 288 may be positioned proximate to the front edge 276. The mating portions 288 represent a receiving part of the contact module 222.

The second housing 270 includes protrusions 290 extending outward from the mating portion 280. The protrusions 290 are configured to be received within the dimples 256 (shown in FIG. 8), which operate to resist rearward horizontal movement of the second contact model 222 with respect to the first contact module 220.

Figure 10:
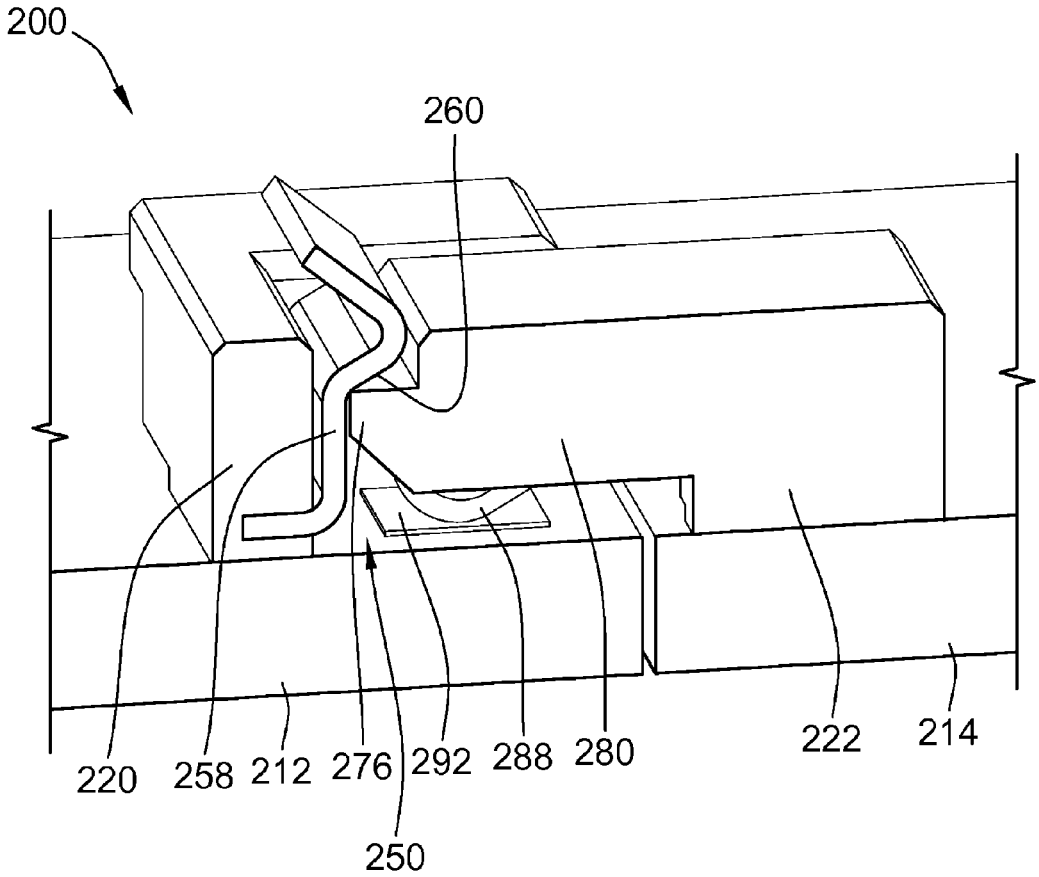
FIG. 10 is a cross-sectional view of the connector system shown in FIG. 7 in a mated state.

FIG. 10 is a cross-sectional view of the connector system 200 in a mated state. The circuit boards 212, 214 are brought together such that the first contact module 220 is coupled to the second contact module 222. The receiving part of the second contact module 222 is received in the receiving space 250 of the first contact module 220. For example, the mating portion 280 and the mating portion 288 are received in the receiving space 250. The main portion 288 directly engages a pad 292 on the top surface of the first circuit board 212.

When assembled, the securing feature 258 securely attaches the second contact module 222 to the first contact module 220. The front edge 276 is configured to be captured under the downward facing ledge 260. Pulling backwards on the securing feature 258 may release the second contact module 222 from the receiving space 250.

Figure 11:
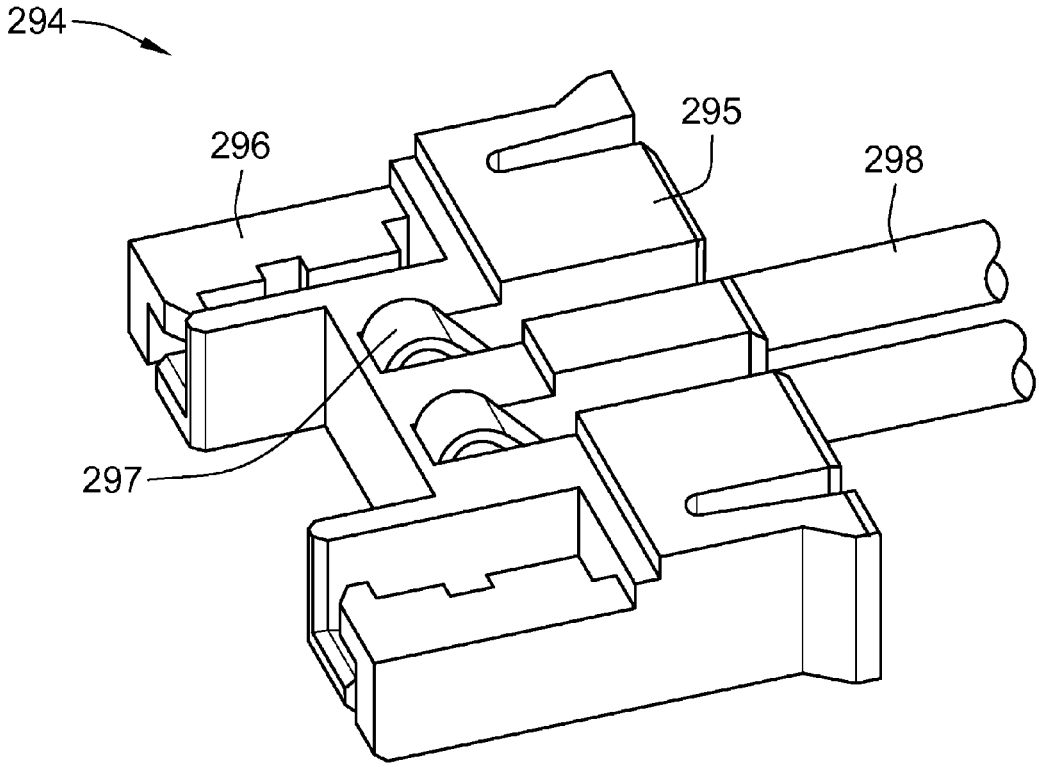
FIG. 11 is a bottom perspective view of a cable connector configured for mating with the contact module shown in FIG. 8.

FIG. 11 is a bottom perspective view of a cable connector 294 configured for mating with the first contact module 220 (shown in FIG. 8). The cable connector 294 includes a body 295 having deflectable latches 296 that securely attaches the cable connector 294 to the contact module 220. The cable connector 294 includes a pair of contacts 297 that are terminated to ends of wires 298. The contacts 297 engage, and are electrically connected to, the pads 292 (shown in FIG. 10) of the first circuit board 212.

Figure 12:
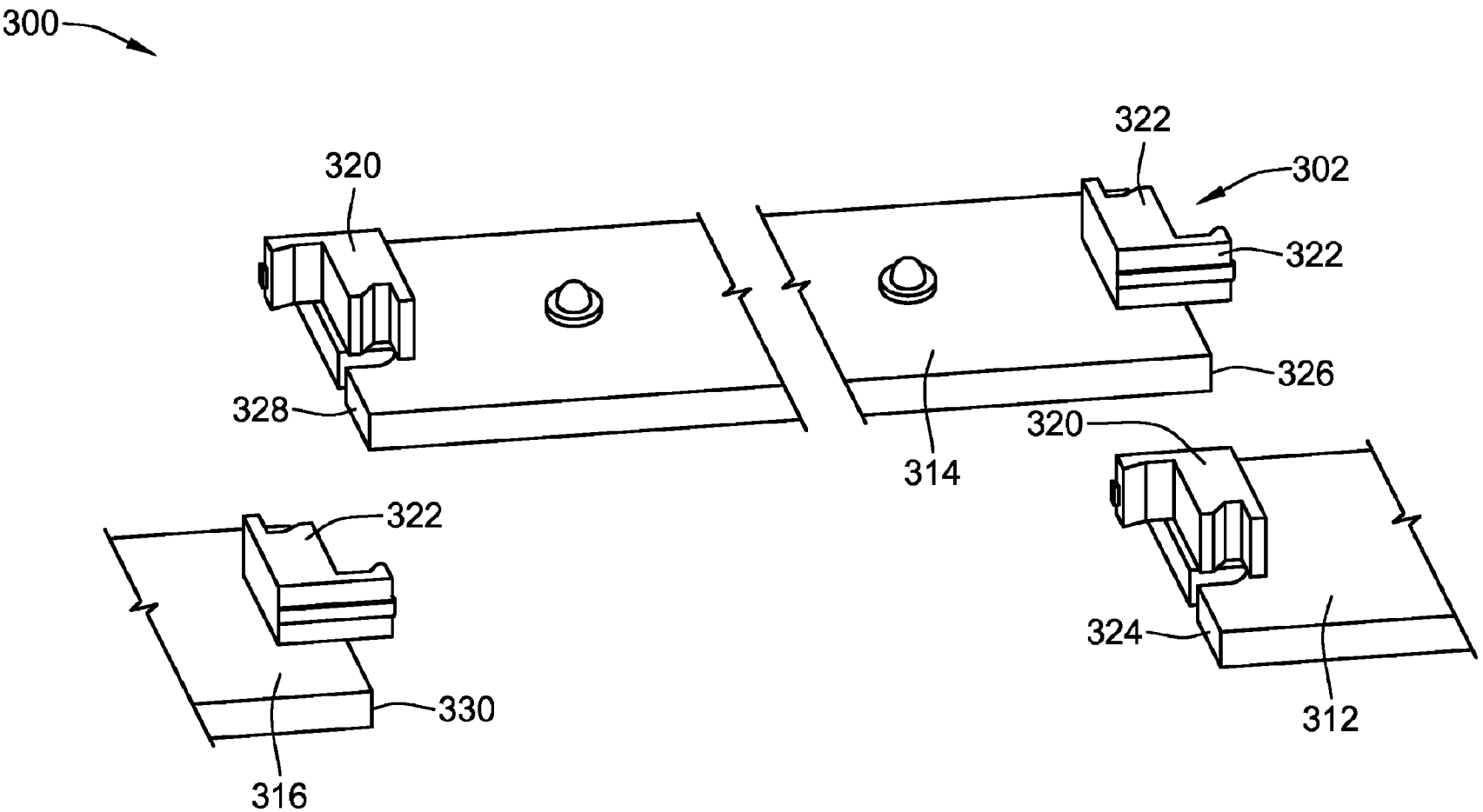
FIG. 12 illustrates another alternative connector system.

FIG. 12 illustrates another alternative connector system 300. The connector system 300 utilizes connector assemblies 302 to interconnect circuit boards 304 to one another. The connector assemblies 302 differ from the connector assemblies 102 illustrated in FIG. 1. Optionally, the circuit boards 304 may be substantially similar to the circuit boards 104 illustrated and FIG. 1.

In the illustrated embodiment, a first circuit board 312, a second circuit board 314, and a third circuit board 316 are being coupled to one another using the connector assemblies 302. The second circuit board 314 is being loaded between the first and third circuit boards 312, 316 in a vertically downward direction, which is generally perpendicular to the horizontally oriented circuit board 314.

Each connector assembly 302 includes a first contact module 320 and a second contact module 322 that are electrically connected to one another. The first contact module 320 is terminated to the first circuit board 312 proximate to an edge 324 thereof. The second contact module 322 is terminated to the second circuit board 314 proximate to an edge 326 thereof. In an exemplary embodiment, the first and second contact modules 320, 322 are identically formed. The contact modules 320, 322 have a dovetail configuration to securely link the contact modules 320, 322 together when assembled. During assembly, the first and second circuit boards 312, 314 are brought against each other, and when properly positioned, the edges 324, 326 face one another. When the first and second circuit boards 312, 314 are brought against each other, the top surfaces of the circuit boards 312, 314 are generally aligned coplanar with one another. As the circuit boards 312, 314 are brought into position, the contact modules 320, 322 are mated with one another. The circuit boards 312, 314 are configured to be brought into position in a vertical direction, as opposed to a horizontal direction. As such, the second circuit board 314 may be removed without removing the first circuit board 312 and/or the third circuit board 316.

Contact modules 320, 322 are mounted to an edge 328 of the second circuit board 314 generally opposite to the edge 324 of the second circuit board 314, and also to an edge 330 of the third circuit board 316 for mating with the contact module 320 at the edge 328 of the second circuit board 316. The contact modules 320, 322 at both edges 326, 328 of the second circuit board 314 are identical to one another, and face in opposite directions.

Figure 13:
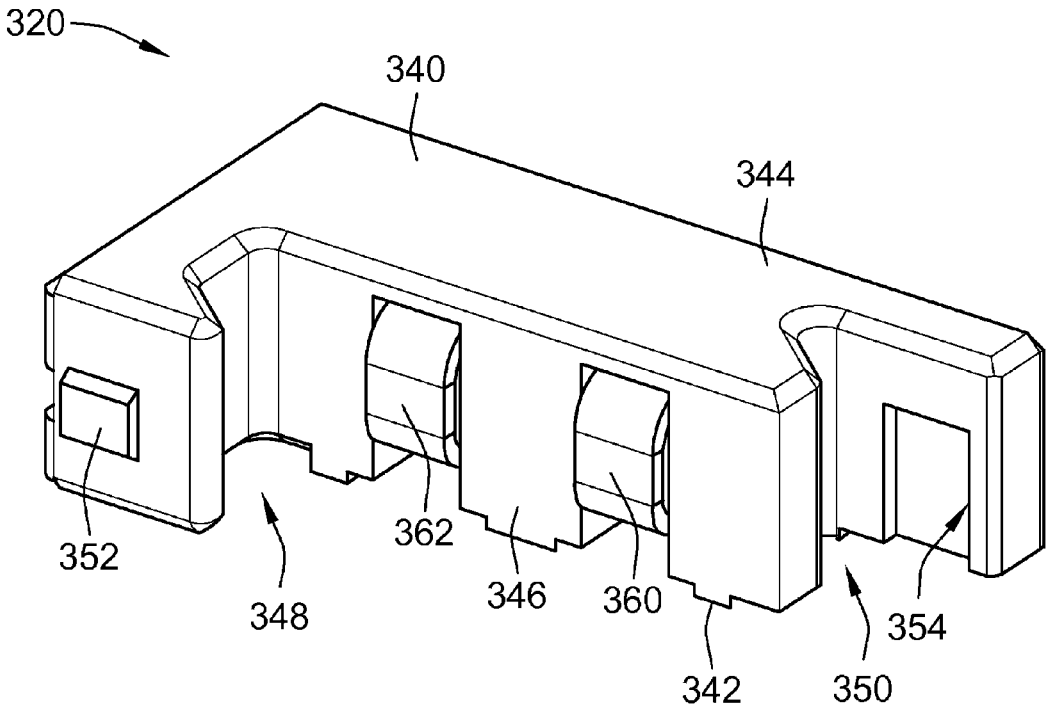
FIG. 13 is a front perspective view of a contact module for the connector system shown in FIG. 12.

FIG. 13 is a front perspective view of the contact module 320. As noted above, the second contact module 322 (shown in FIG. 12) may be identical to, or substantially similar to, the contact module 320. The contact module 320 includes a housing 340 having a bottom 342 and a top 344. The housing 340 has a central mating face 346.

A receiving part 348 extends forwardly from the mating face 346 and one of the sides thereof. A receiving space 350 extends rearwardly from the mating face 346 at the opposite side thereof. The receiving part 348 is configured to be received in a corresponding receiving space in the second contact module 322. The receiving space 350 is configured to receive a corresponding receiving part of the second contact module 322. The receiving part 348 and the receiving space 350 have complementary shapes such that the first and second contact modules 322 may co-nest with one another. The co-nesting or dovetailing of the contact modules 320, 322 resist horizontal movement of the contact modules 320, 322 with respect to one another.

The receiving part 348 has a protrusion 352 extending outward therefrom. The receiving space 350 has a dimple 354 formed therein. The protrusion 352 is configured to be received within a corresponding dimple in the second contact module 322. Similarly, the dimple 354 is configured to receive a corresponding protrusion of the second contact module 322. The protrusions 352 and dimples 354 operate to resist vertical movement of the second contact module 322 with respect to the first contact module 320.

The contact modules 320 each include a pair of contacts 360 held by the housing 340. Any number of contacts 360 may be provided depending on the particular application. The contacts 360 each have a mounting portion (not shown) configured for mounting to the circuit board 312 and a mating portion 362 configured for mating to corresponding contacts of the second contact module 322. The mating portions 362 may be spring contacts that may be biased against the corresponding contacts of the second contact module 322. The mating portions 362 are positioned along the central mating face 346.

Figure 14:
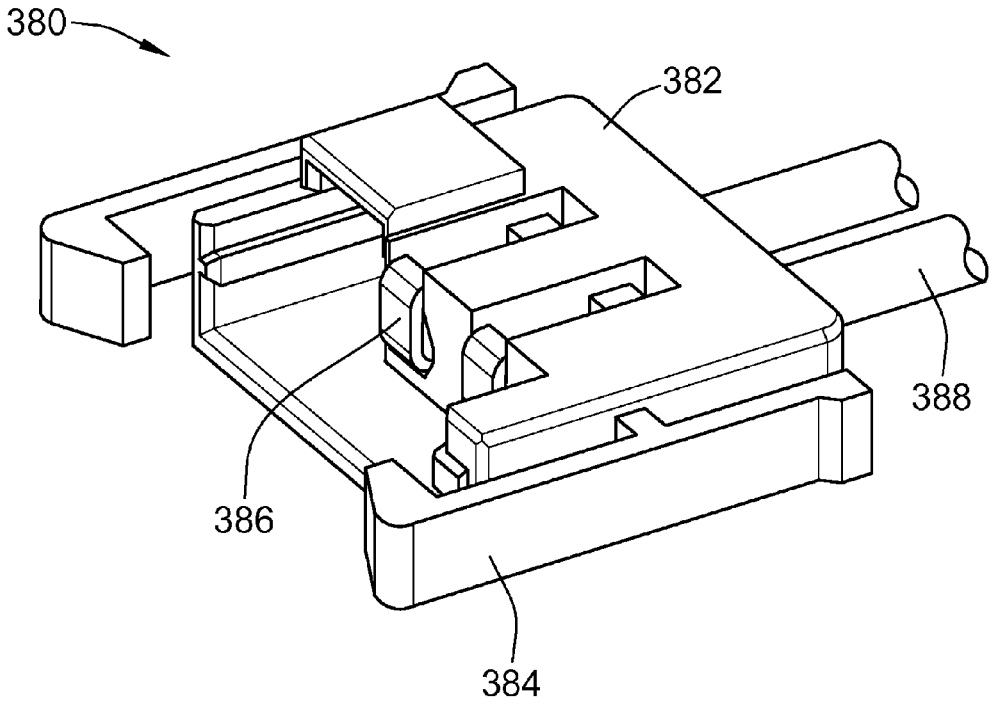
FIG. 14 is a bottom perspective view of a cable connector configured for mating with the contact module shown in FIG. 13.

FIG. 14 is a bottom perspective view of a cable connector 380 configured for mating with the contact module 320 (shown in FIG. 13). The cable connector 380 includes a body 382 having deflectable latches 384 that securely attach the cable connector 380 to the contact module 320. The cable connector 380 includes a pair of contacts 386 that are terminated to ends of wires 388. The contacts 386 engage, and are electrically connected to, the contacts 360 (shown in FIG. 13) of the contact module 320.

Figure 15:
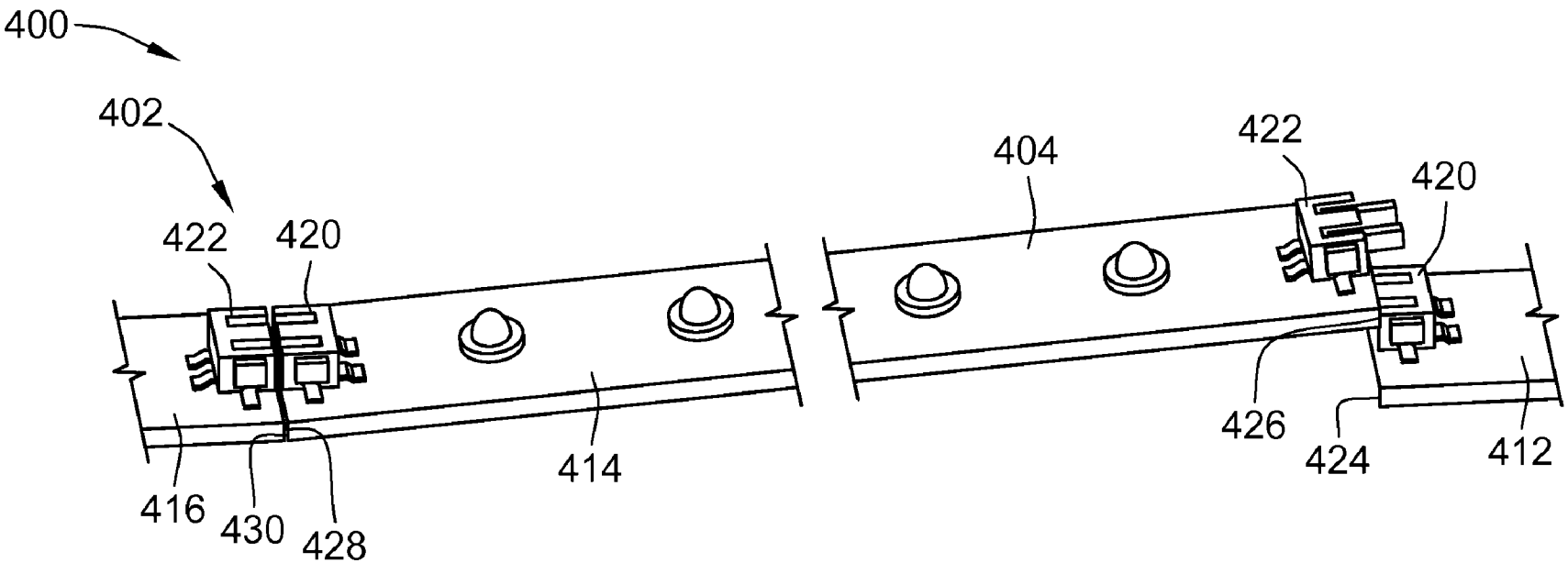
FIG. 15 illustrates yet another alternative connector system.

FIG. 15 illustrates yet another alternative connector system 400. The connector system 400 utilizes connector assemblies 402 to interconnect circuit boards 404 to one another. The connector assemblies 402 differ from the connector assemblies 102 illustrated in FIG. 1. Optionally, the circuit boards 404 may be substantially similar to the circuit boards 104 illustrated and FIG. 1.

In the illustrated embodiment, a first circuit board 412, a second circuit board 414, and a third circuit board 416 are being coupled to one another using the connector assemblies 402. The second circuit board 414 is being loaded between the first and third circuit boards 412, 416 at an angle. Alternatively, the second circuit board 414 may be mated with the first circuit board 412 by loading the second circuit board 414 into position in a vertically downward direction, a vertically upward direction, or a horizontal direction.

Each connector assembly 402 includes a first contact module 420 and a second contact module 422 that are electrically connected to one another. The first contact module 420 is terminated to the first circuit board 412 proximate to an edge 424 thereof. The second contact module 422 is terminated to the second circuit board 414 proximate to an edge 426 thereof. In an exemplary embodiment, the first contact module 420 constitutes a receptacle or socket and the second contact module 422 constitutes a plug that is received in the receptacle. During assembly, the first and second circuit boards 412, 414 are brought against each other, and when properly positioned, the edges 424, 426 face one another. When the first and second circuit boards 412, 414 are brought against each other, the top surfaces of the circuit boards 412, 414 are generally aligned coplanar with one another. As the circuit boards 412, 414 are brought into position, the contact modules 420, 422 are mated with one another. In an exemplary embodiment, the first contact module 420 is recessed from the edge 424 and the second contact module 422 extends outward from the edge 426.

A first contact module 420 is mounted to an edge 428 of the second circuit board 414 generally opposite to the edge 424 of the second circuit board 414, and a second contact module 422 is mounted to an edge 430 of the third circuit board 416 for mating with the first contact module 420 at the edge 428 of the second circuit board 416.

Figure 16:
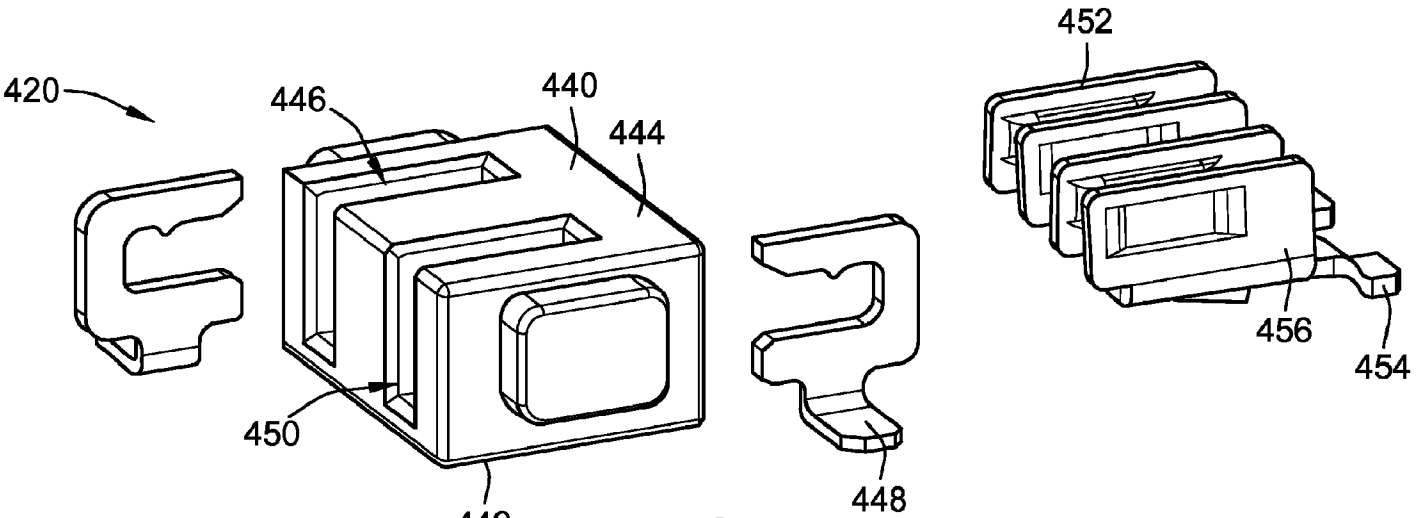
FIG. 16 is an exploded perspective view of a contact module for the connector system shown in FIG. 15.

FIG. 16 is an exploded perspective view of the first contact module 420. The contact module 420 includes a first housing 440 having a bottom 442 and a top 444. The first housing 440 has contact channels 446 extending therethrough. Mounting tabs 448 are coupled to the first housing 440. The mounting tabs 448 are configured to be mounted to the top surface of the circuit board 412, such as by soldering to mounting pads (not shown).

The first housing 440 includes a receiving space 450 configured to receive a portion of the second contact module 422 (shown in FIG. 15). The receiving space 450 is represented by a chamber having an open top and an open front. Optionally, the receiving space 450 may also include an open bottom. Contacts 452 are loaded into the contact channels 446. The contact 452 are positioned within the receiving space 450 for mating with a portion of the second contact module 422. In the illustrated embodiment, the contacts 452 are identical to one another and constitute sockets. The contacts 452 each include a mounting portion 454 configured for mounting to the circuit board 412. In the illustrated embodiment, the mounting portions 454 represent mounting pads configured to be surface mounted, and soldered, to the circuit board 412. Each contact 452 includes a pair of contact arms 456 that are open at the top thereof generally opposite the mounting portion 454. Optionally, the contacts 450 may be generally U-shaped with an open top and an open front.

Figure 17:
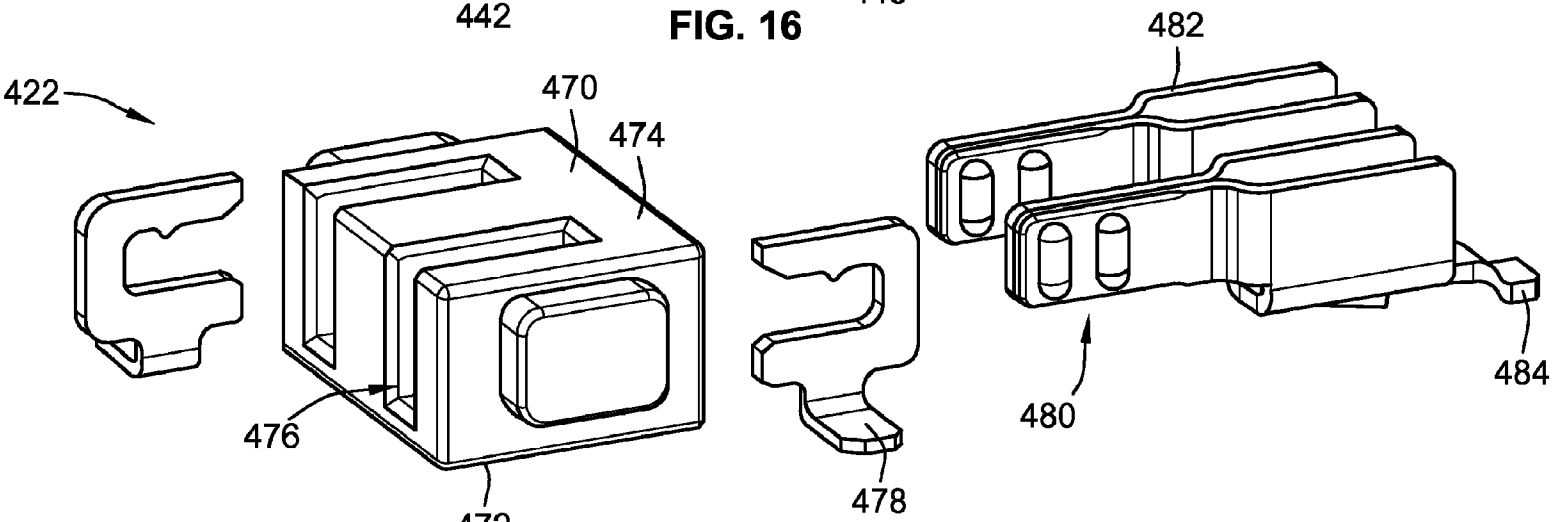
FIG. 17 is an exploded perspective view of another contact module for the connector system shown in FIG. 15.

FIG. 17 is an exploded perspective view of the second contact module 422. The contact module 422 includes a second housing 470 having a bottom 472 and a top 474. The second housing 470 has contact channels 476 extending therethrough. Mounting tabs 478 are coupled to the second housing 470. The mounting tabs 478 are configured to be mounted to the top surface of the circuit board 414, such as by soldering to mounting pads (not shown).

The contact module 422 includes a receiving part 480 that is configured to extend outward from the front of the second housing 470. In the illustrated embodiment, the receiving part 480 is represented by contacts 482 that are configured to extend forward of the second housing 470. The contacts 482 constituted blade-type contacts or pin-type contacts that are configured to be received within the receiving space 450 (shown in FIG. 8) and the socket-type contacts 452. The contacts 482 each include a mounting portion 484 configured for mounting to the circuit board 414. In the illustrated embodiment, the mounting portions 484 represent mounting pads configured to be surface mounted, and soldered, to the circuit board 414. Optionally, the contacts 482 may be stamped and formed.

Figure 18:
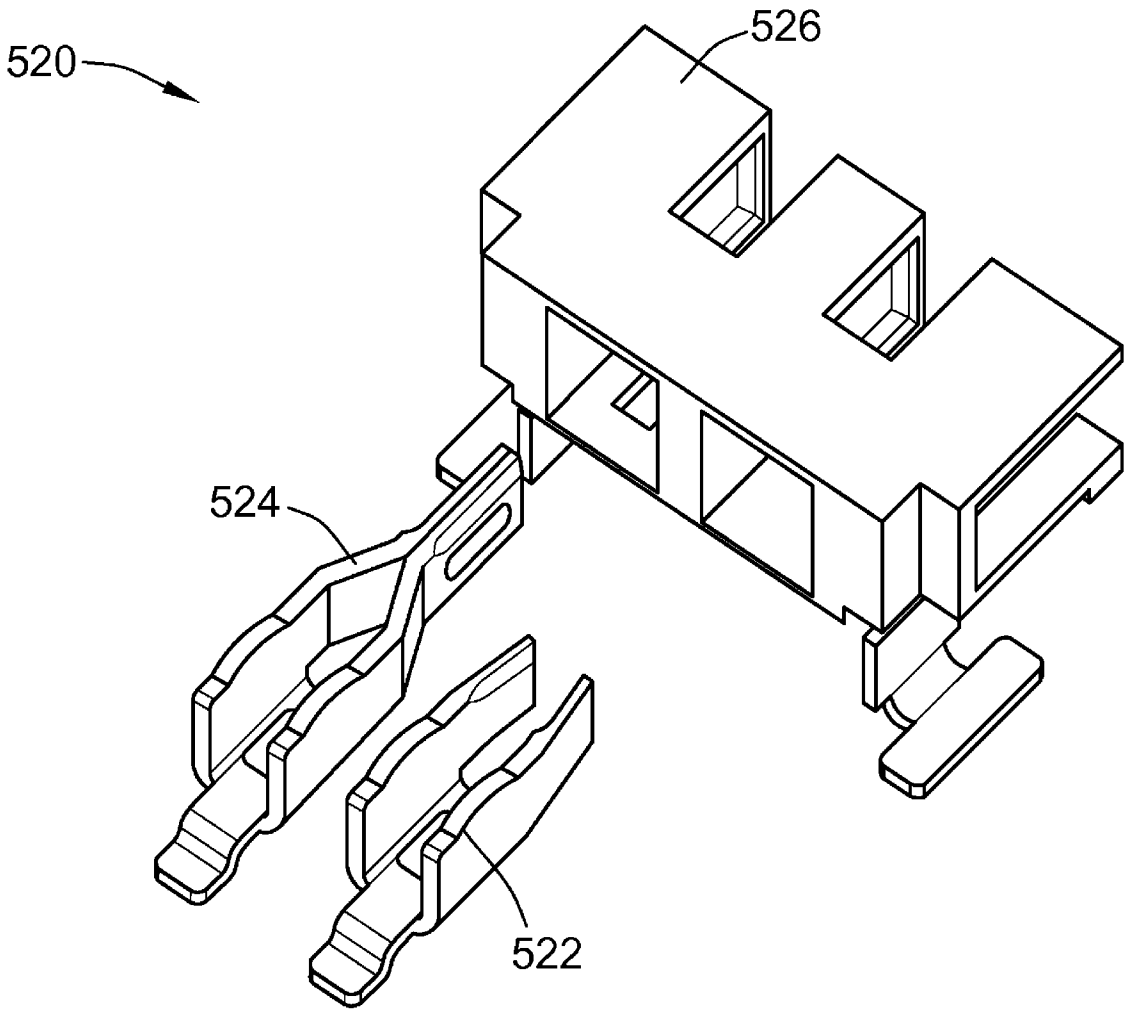
FIG. 18 is an exploded perspective view of yet another contact module for the connector system shown in FIG. 15.

FIG. 18 is an exploded perspective view of yet another contact module 520 for the connector system 400 (shown in FIG. 15). The contact module 520 may replace the contact modules 420, 422 (shown in FIG. 15). The contact module 520 is hermaphroditic and includes both a socket contact 522 and a blade contact 524. The contacts 522, 524 are received within a housing 526 of the contact module 520. Contact modules 520 are positioned at both edges of the circuit boards. When the circuit boards are brought together, the contact modules 520 at the edges of adjacent circuit boards are mated with each other.

Each contact module 520 has a receiving part and a receiving space that receives a corresponding receiving part of another contact module 520. The receiving space is represented by an opening in the housing 526 and the socket contact 522. The receiving part is represented by the blade portion of the blade contact 524 that extends outward from the housing 526. The blade contacts 524 are received within the socket contacts 522 of the corresponding contact modules 520 to make electrical connection therebetween.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a first contact module terminated to a first circuit board proximate to an edge of the first circuit board, the first contact module having a first housing holding first contacts, the first contacts being electrically connected to the first circuit board;

a second contact module terminated to a second circuit board proximate to an edge of the second circuit board, the second contact module having a second housing holding second contacts, the second contacts being electrically connected to the second circuit board; and a jumper module electrically connecting the first contacts and the second contacts, the jumper module movable independently of the first and second housings between a mated state and an unmated state, the first and second contacts being electrically connected in the mated state;

wherein, when the jumper module is in the unmated state, the first circuit board and the second circuit board can be brought together from a plurality of different directions, the jumper module being moved to the mated state after the first and second circuit boards are brought together; and wherein the jumper module is separate from both the first and second contact modules in the unmated state, the jumper module being simultaneously coupled to both the first and second contact modules after the first and second circuit boards are brought together.

2. The connector system of claim 1, wherein the first and second circuit boards are coplanar with one another along a board plane after being brought together, the first and second circuit boards can be brought together in a direction that is non-parallel to the board plane.

3. The connector system of claim 1, wherein the first and second circuit boards are arranged horizontally, the first and second circuit boards can be brought together in a vertical direction.

4. The connector system of claim 1, wherein the jumper module is movable between the mated state and the unmated state in a linear direction that is parallel to the first and second circuit boards.

5. The connector system of claim 1, wherein the jumper module is slidably coupled to the first contact module, the jumper module being slid along surfaces of the first and second circuit boards to the mated state, the jumper module spanning across the edges of the first and second circuit boards in the mated state.

6. The connector system of claim 1, wherein the jumper module has a body holding jumper contacts, the jumper contacts engaging the first contacts and the second contacts when the jumper module is in the mated state.

7. The connector system of claim 1, wherein the jumper module has a body holding planar jumper contacts, the jumper contacts being parallel to one another, the jumper contacts engaging the first contacts and the second contacts when the jumper module is in the mated state.

8. The connector system of claim 1, wherein the first and second contact modules include latching features, the jumper module including latching features that engage the latching features of the first and second contact modules.

9. The connector system of claim 1, wherein the first housing has a top with openings, the first contacts being exposed within the opening, and wherein the second housing having a top with openings, the second contacts being exposed within the opening, the jumper module having jumper contacts received in the openings of the first housing and the second housing when in the mated state to electrically connect the first and second contacts.

10. A connector system comprising:

a first contact module terminated to a first circuit board proximate to an edge of the first circuit board, the first contact module having a first housing holding first contacts, the first contacts being electrically connected to the first circuit board;

a second contact module terminated to a second circuit board proximate to an edge of the second circuit board, the second contact module having a second housing holding second contacts, the second contacts being electrically connected to the second circuit board; and a jumper module electrically connecting the first contacts and the second contacts, the jumper module movable independently of the first and second housings between a mated state and an unmated state, the first and second contacts being electrically connected in the mated state:

wherein, when the jumper module is in the unmated state, the first circuit board and the second circuit board can be brought together from a plurality of different directions, the jumper module being moved to the mated state after the first and second circuit boards are brought together; and wherein the first and second contact modules are identical to one another, the first and second housings being T-shaped with a base and a cap extending outward from the base to form ledges, the jumper module having a T-shaped opening that receives the T-shaped first and second housings.

11. The connector system of claim 10, wherein the first and second circuit boards are coplanar with one another along a board plane after being brought together, the first and second circuit boards can be brought together in a direction that is non-parallel to the board plane.

12. The connector system of claim 10, wherein the jumper module is separate from both the first and second contact modules in the unmated state, the jumper module being simultaneously coupled to both the first and second contact modules after the first and second circuit boards are brought together.

13. The connector system of claim 10, wherein the first housing has a top with openings, the first contacts being exposed within the opening, and wherein the second housing having a top with openings, the second contacts being exposed within the opening, the jumper module having jumper contacts received in the openings of the first housing and the second housing when in the mated state to electrically connect the first and second contacts.

14. A connector system for interconnecting first and second circuit boards together, the first and second circuit boards each having a top surface defining a board plane and a board perimeter, the first and second circuit boards each having a mating edge, the connector system comprising:

a first contact module having a first housing holding first contacts, the first housing having a top with openings, the first contacts being exposed within the opening, the first contacts being configured to be terminated to the first circuit board proximate to the mating edge of the first circuit board, the first contact module being arranged on the top surface of the first circuit board such that the first contact module is entirely within the board perimeter of the first circuit board;

a second contact module having a second housing holding second contacts, the second housing having a top with openings, the second contacts being exposed within the opening, the second contacts being configured to be terminated to the second circuit board proximate to the mating edge of the second circuit board, the second contact module being arranged on the top surface of the second circuit board such that the second contact module is entirely within the board perimeter of the second circuit board; and a jumper module configured to be coupled to the first and second contact modules, the jumper module movable independently of the first and second housings between a mated state and an unmated state, the jumper module having jumper contacts received in the openings of the first housing and the second housing when in the mated state to electrically connect the first and second contacts;

wherein, when in the mated state, the jumper module spans across the mating edges to electrically connect the first and second contacts, and when in the unmated state, the jumper module is positioned in a non-blocking position with respect to the mating edges such that the first circuit board and the second circuit board can be brought together, or taken apart, in a direction that is non-parallel to the board planes.

15. The connector system of claim 14, wherein the jumper module is slidably coupled to the first contact module, the jumper module being slid along the top surfaces of the first and second circuit boards to the mated state, the jumper module spanning across the edges of the first and second circuit boards in the mated state.

16. The connector system of claim 14, wherein the jumper module has a body holding the jumper contacts, the jumper contacts being planar, the jumper contacts being parallel to one another, the jumper contacts engaging the first contacts and the second contacts when the jumper module is in the mated state.

17. The connector system of claim 14, wherein the jumper module is slidably coupled to the first contact module, the jumper module being slid along surfaces of the first and second circuit boards to the mated state, the jumper module spanning across the edges of the first and second circuit boards in the mated state.

18. The connector system of claim 14, wherein the first and second contact modules are identical to one another, the first and second housings being T-shaped with a base and a cap extending outward from the base to form ledges, the jumper module having a T-shaped opening that receives the T-shaped first and second housings.

19. The connector system of claim 14, wherein the first and second contact modules include latching features, the jumper module including latching features that engage the latching features of the first and second contact modules.

20. The connector system of claim 14, wherein the jumper module is separate from both the first and second contact modules in the unmated state, the jumper module being simultaneously coupled to both the first and second contact modules after the first and second circuit boards are brought together.

* * * * *